US005946807A

United States Patent [19]

Crane et al.

[11] Patent Number: 5,946,807

[45] Date of Patent: Sep. 7, 1999

[54] NOVELTY SPOON

[75] Inventors: John A. Crane; Cyril Crane, both of Downers Grove, Ill.

[73] Assignee: Jac Investments, Inc., Elk Grove Village, Ill.

[21] Appl. No.: 09/109,541

[22] Filed: Jul. 2, 1998

[51] Int. Cl.[6] ..... A47J 43/28

[52] U.S. Cl. ..... 30/141; 30/324; D7/300.2

[58] Field of Search ..... 30/123, 141, 324, 30/326, 327; 446/72, 74; D7/300.2, 643, 653, 654, 655, 656, 657, 664

[56] References Cited

U.S. PATENT DOCUMENTS

| | | | |
|---|---|---|---|
| D. 392,148 | 3/1998 | Lewis | D7/300.2 |
| 674,446 | 5/1901 | Marx | 30/141 |
| 1,606,038 | 11/1926 | Norman | 30/141 |
| 2,334,535 | 11/1943 | Bandell | 30/141 |
| 2,698,996 | 1/1955 | Hickerson | 30/123 |
| 2,787,055 | 4/1957 | Wertz | 30/123 |
| 2,859,515 | 11/1958 | Kinman | 30/141 |
| 3,038,256 | 6/1962 | Mayer | 30/141 |
| 3,968,591 | 7/1976 | Pearson | 30/324 |
| 4,719,702 | 1/1988 | Hoffman | 30/326 |
| 4,779,344 | 10/1988 | Panisch | 30/326 |
| 5,479,708 | 1/1996 | Thomas | 30/324 |
| 5,727,321 | 3/1998 | Lewis | 30/141 |

*Primary Examiner*—Hwei-Siu Payer
*Attorney, Agent, or Firm*—Knechtel, Demeur & Samlan

[57] ABSTRACT

A hand held eating and drinking utensil that is constructed to be used for the dual purpose of serving as a spoon for eating and as a straw for drinking. The utensil is in the form of a spoon having a handle with a bowl for eating food as a spoon and having a handle that is hollow throughout its center for use as a straw to suck liquid or bits of food through the handle into a child's mouth. A decorative figure is attached to the handle for easier grasping and holding of the utensil while providing an amusing device for the child to play with either with or without any food or liquid thereon.

5 Claims, 1 Drawing Sheet

NOVELTY SPOON

I. FIELD OF THE INVENTION

The present invention relates to the design and construction of hand held eating and drinking utensils and, more particularly, to a spoon that can be operated as a straw.

II. DESCRIPTION OF THE PRIOR ART

During meals, children often require two different utensils for eating and drinking. For example, soup having bits of food in it can be consumed through a spoon or a straw. Children are faced with the dilemma of which utensil to use. Moreover, children need encouragement at times to eat their meal or merely desire to experience a more pleasurable eating experience during meal time.

Also, food manufacturers often place promotional items in cereal or candy boxes. Such items must be designed so that they can be packaged in a flat configuration, must be inexpensively manufactured, and must be safe in the hands of children. Furthermore, such products must meet stringent requirements for food applications. It is also advantageous if such items are easily modified to provide for several different types of amusing and decorative utensils without changing the operational aspects of the product.

In the past, various types of children's utensils have been developed. For instance, in U.S. Pat. No. 2,787,055 entitled "Articulated Toy and Spoon For Hand Feeding An Infant" discloses an articulated toy spoon which protrudes through a face of a cartoon like character. The idea of this device is to take the child's mind off eating and have the child's attention directed toward the cartoon like face through which the spoon protrudes. Likewise, U.S. Pat. No. 4,779,344 entitled "Manipulatable Utensil Figure" discloses a hand held eating utensil that has a figure member positioned on the handle of the utensil. The figure can be operated by placing a finger within the figure to manipulate its placement along the handle. Neither spoon, however, is designed to be used as a straw.

U.S. Pat. No. 3,968,591 entitled "Combined Spoon and Toy" discloses a spoon with a toy integrally interposed between the ladle and handle portions of the spoon. This device provides an incentive for small children to eat their food. However, this device does not permit the spoon to be used as a straw.

U.S. Pat. No. 2,698,996 entitled "Food or Medicine Administering Spoon" there is disclosed a spoon that uses a reservoir containing a measured amount of food or liquid and a plunger to regulate the amount of food or liquid pushed through an opening in the bowl of the spoon for intake. Although this device allows food or fluid to be pushed through an opening in the spoon from an enclosed reservoir, the device does not permit intake of the food or fluid through a straw formed within the spoon. Instead, the device must always be used as a spoon.

As illustrated by the prior devices, there has never been disclosed a hand held utensil configured to operate both as a spoon for eating and a straw for drinking. Accordingly, applicant's invention provides a hand held eating and drinking utensil that can be operated both as a spoon and as a straw.

III. OBJECTS OF THE INVENTION

It is the primary object of the present invention to provide a novel construction of a hand held utensil that can be used for the dual purpose of serving as a spoon for eating and as a straw for drinking.

Another object of the invention is to provide a decorative figure on the hand held eating and drinking utensil which induces the child to eat or drink his food and still provide an amusing device for the child to play with either with or without any food or liquid thereon.

A related object is to provide a decorative figure on the hand held eating and drinking utensil that allows for easier grasping and holding of the utensil by the child for eating or drinking his food.

Still another object of the invention is to provide a hand held eating and drinking utensil that can be inexpensively made of several parts, packaged in a flat configuration, and easily assembled by the user.

Other objects of the present invention will become more apparent to persons having ordinary skill in the art to which the present invention pertains from the following description taken in conjunction with the accompanying drawings.

IV. SUMMARY OF THE INVENTION

The present invention is a novel construction for a hand held utensil that can be used for the dual purpose of serving as a spoon for eating and as a straw for drinking. The utensil consists of three main parts: a handle, a bowl, and a decorative figure.

The handle is an elongated cylindrical tube with a hollow bore extending through the center the entire length of the handle. The handle consists of two pieces, the forward handle portion and the rearward handle portion, which are snapped together end to end to form one elongated piece.

The bowl is formed at the forward handle portion. The decorative figure is attached to the rearward handle portion. Locating posts protrude from the exterior of the rearward handle portion for receiving and holding the decorative figure in place on the rearward handle portion.

The child can grasp any portion of the handle for eating or drinking. The decorative figure, besides acting as an amusement for the child, provides the child with a larger handle for easier grasping of the utensil. The hand held utensil can then either be used in a scooping manner to collect food or inserted into a liquid such that the liquid can be sucked through the hollow portion of the handle into the child's mouth.

V. BRIEF DESCRIPTION OF THE DRAWINGS

VI. DETAILED DESCRIPTION OF THE PREFERRED EMBODIMENT

Figure 1:
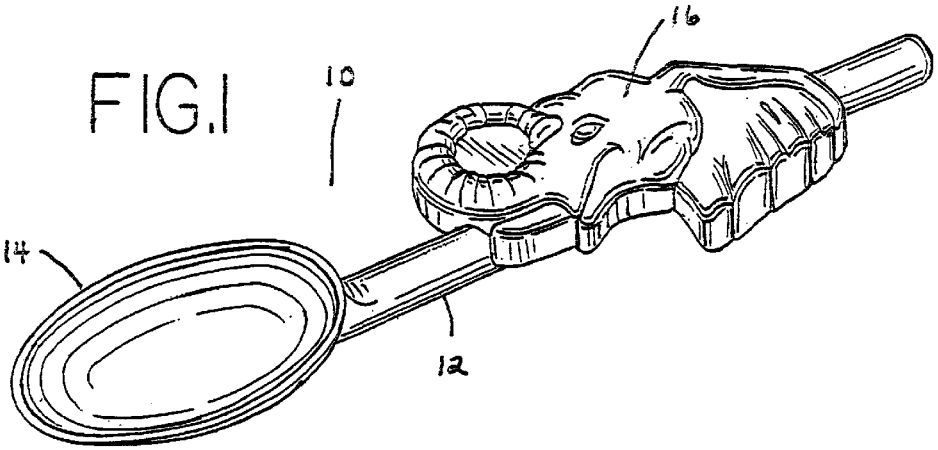
FIG. 1 is a perspective view of applicant's invention showing the spoon with the decorative figure attached to the handle portion of the spoon.

Turning first to FIG. 1, there is illustrated a hand held eating and drinking utensil, and more particularly a spoon 10. The spoon 10 is comprised of a handle 12, a bowl 14, and a decorative figure 16. The bowl 14 is formed into one end of the handle 12. The decorative figure 16 is attached to the exterior of the handle 12. The decorative figure 16 is illustrated to be an elephant, but the decorative figure 16 may be any type of figure or design including but not limited to animals and human or fictitious characters. Furthermore, the decorative figure 16 can be textured to resemble the particulars of the animal or character used.

Figure 2:
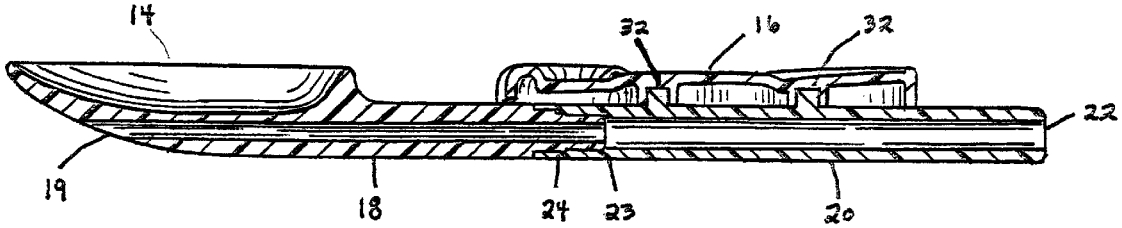
FIG. 2 is a side cross sectional view of the spoon showing the bowl, handle, and decorative figure in its assembled position.

Turning to FIG. 2, the component parts of the spoon 10 are more clearly illustrated, particularly the handle 12. The handle 12 is an elongated cylindrical tube with a hollow bore 19 extending through the center of the entire length of the handle 12 to a drinking end 22. The handle 12 is comprised of two pieces: a forward handle portion 18 and a rearward handle portion 20. The forward handle portion 18 and the rearward handle portion 20 are snapped together end to end at a point of attachment 23 to form one elongated piece. The bowl 14 is formed at the forward handle portion 18. The bowl 14 is oval in shape with an opening at the top to collect the food and closed at the bottom to hold the food.

The decorative figure 16 is attached to the rearward handle portion 20 and preferable covers the point of attachment 23 between the forward handle portion 18 and the rearward handle portion 20. Approximately one-half of the decorative figure 16 encompasses approximately one-half of the tubular exterior of the handle 12 with the other one-half of the decorative figure 16 protruding above the exterior of the handle 12. The decorative figure 16 is situated along the handle 12 approximately midway from the closest point of the bowl 14 and the drinking end 22. This distance allows a child to eat the food from the bowl 14 or drink the food from the drinking end 22. The open end of the bowl 14 and the decorative figure 16 are formed and attached, respectively, on the same side of the handle 12.

Figure 3:
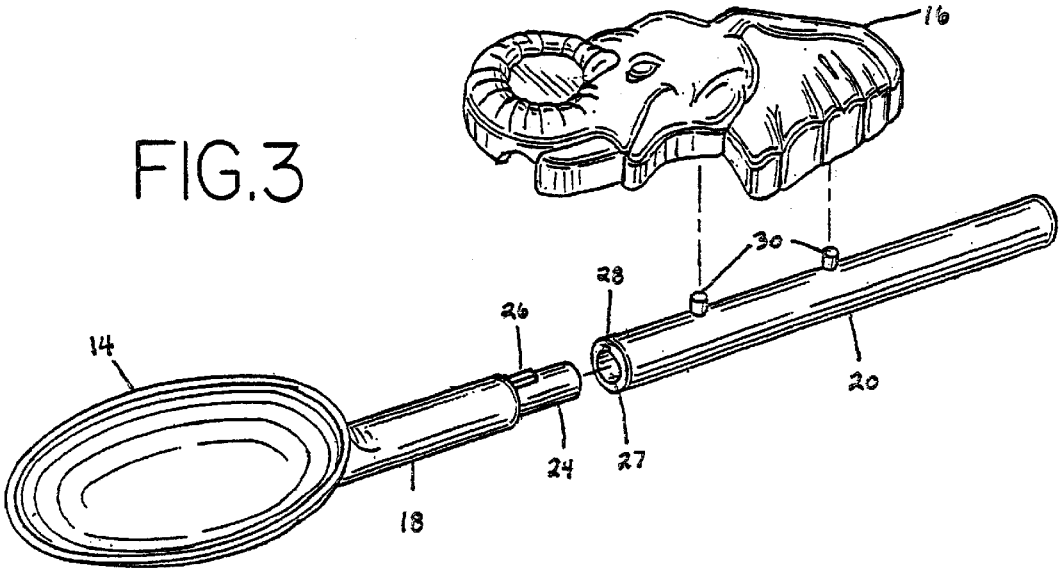
FIG. 3 is an exploded view of the spoon of FIG. 1 with the handle detached into its separate pieces, and the decorative figure detached from the handle.

Turning to FIG. 3, the assembly of the spoon 10 can be more clearly described. The forward handle portion 18 is attached to the rearward handle portion 20 through the insertion of the combination of an internal peg 24 and a key 26 on the forward handle portion 18 into a hollow opening 27 and a kewyay 28 of the rearward handle portion 20. The internal peg 24 is an extension of the forward handle portion 18, but is slightly smaller in diameter than the outer diameter of the forward handle portion 18. The internal peg 24 is of sufficient length to facilitate a tight connection upon the snapping of the relative ends of the forward handle portion 18 and the rearward handle portion 20 together. The key 26 is slightly smaller than the keyway 28 in order for the keyway 28 to receive the key 26. Following the insertion of the key 26 into the keyway 28, the keyway 28 acts to hold the forward handle portion 18 from rotating within the rearward handle portion 20. The prevention of this rotation allows the child to use the spoon 10 without the forward handle portion 18 rotating and forcing the bowl 14 to drop whatever food it contained.

The decorative figure 16 is attached to the rearward handle portion 20 through two locating posts 30. The locating posts 30 are sufficiently spaced from one another to create a secure attachment of the decorative figure 16 to the handle 12. As seen in FIG. 2, the decorative figure 16 contains corresponding holes 32 for receiving the locating posts 30.

It is recommended that the indiviudual components be injection molded from a food grade plastic material. Furthermore, the plastic material should not be made of a plastic that is easily chipped or broken, due to the fact that children will be biting on the bowl 14 and the handle 12. The plastic comonents should also have resiliency. The forward handle portion 18, the rearward handle portion 20, and the decorative figure 16 can each be injection molded as a separate component. The bowl 14 is to be injection molded integrally with the forward handle portion 18. The three components are then snapped together to form the finished product.

Thus, there has been provided a novelty spoon which can be used as a spoon or a straw. While the invention has been described in conjunction with a specific embodiment, it is evident that many alternatives, modifications and variations will be apparent to those skilled in the art in light of the foregoing description. Accordingly, it in intended to embrace all such alternatives, modifcations and variations as fall within the spirit and scope of the appended claims.

What is claimed is:

1. A hand held eating and drinking utensil comprising:

a handle having a forward handle portion and a rearward handle portion, the forward handle portion and the rearward handle portion each having a forward end and a rearward end, the forward handle portion having an internal peg with an attached key at the rearward end, of the forward handle portion the rearward handle portion having a keyway at the forward end, of the rearward handle portion the internal peg with the attached key of the forward handle portion being received into the keyway of the rearward handle portion;

a hollow passageway extending throughout the center of each handle portion from the forward end to the rearward end;

a bowl connected to the forward end of the forward handle portion; and a decorative figure connected to the rearward handle portion.

2. A spoon and straw combination comprising:

a cylindrical tube having an open forward end and an open rearward end, a hollow passageway extending throughout the center of the tube from the forward end to the rearward end;

a bowl connected to the forward end of the tube; and a means for securing a decorative figure to the tube.

3. The spoon and straw combination of claim 2 wherein the means for securing a decorative figure to the tube comprises locating posts on the tube and locating holes in the decorative figure, the locating posts of the tube being received into the locating holes in the decorative figure to connect the decorative figure to the tube.

4. The spoon and straw combination of claim 2 wherein the tube is formed from two cylindrical tubes joined together along their long axis.

5. A hand held eating and drinking utensil comprising:

a handle having a forward handle portion and a rearward handle portion, the forward handle portion and the rearward handle portion each having a forward end and a rearward end, the rearward end of the forward handle portion connected to the forward end of the rearward handle portion;

a hollow passageway extending throughout the center of each handle portion from the forward end to the rearward end;

a bowl connected to the forward end of the forward handle portion; and a decorative figure connected to the rearward handle portion, the rearward handle portion having locating posts, the decorative figure having locating holes, the locating posts being received into the locating holes to connect the decorative figure to the rearward handle portion.

* * * * *